US006913527B2

(12) United States Patent
He

(10) Patent No.: US 6,913,527 B2
(45) Date of Patent: Jul. 5, 2005

(54) EDGE-SEALED PAD FOR CMP PROCESS

(75) Inventor: Yanghua He, Richardson, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/893,404

(22) Filed: Jul. 15, 2004

(65) Prior Publication Data

US 2005/0003738 A1 Jan. 6, 2005

Related U.S. Application Data

(62) Division of application No. 10/434,246, filed on May 8, 2003, now Pat. No. 6,783,437.

(51) Int. Cl.[7] ..... C24B 29/02

(52) U.S. Cl. ..... 451/259; 451/921; 451/533; 451/530

(58) Field of Search ..... 451/259, 921, 451/490, 526, 533, 538, 530, 285, 281, 292; 428/212, 54.1, 64.1; 438/692–693; 51/297

(56) References Cited

U.S. PATENT DOCUMENTS 4,162,899 A 7/1979 Molnar et al.
5,310,455 A * 5/1994 Pasch et al. ..... 156/211
5,403,228 A * 4/1995 Pasch ..... 451/259
5,624,304 A 4/1997 Pasch et al.
5,738,574 A 4/1998 Tolles et al.
6,090,475 A * 7/2000 Robinson et al. ..... 428/212
6,123,609 A 9/2000 Satou
6,220,942 B1 4/2001 Tolles et al.
6,251,215 B1 6/2001 Zuniga et al.
6,331,137 B1 * 12/2001 Raeder et al. ..... 451/285
6,439,968 B1 8/2002 Obeng
6,620,036 B2 9/2003 Freeman et al.
2001/0005667 A1 6/2001 Tolles et al.

* cited by examiner

*Primary Examiner*—George Nguyen
(74) *Attorney, Agent, or Firm*—Peter K. McLarty; W. James Brady, III; Frederick J. Telecky, Jr.

(57) ABSTRACT

The present invention discloses a polishing pad that can facilitate process stability, extend length of use, and mitigate process non-uniformity and process induced defects for chemical mechanical planarization processes. The polishing pad of the present invention is a composite of a top pad and a sealed sub-pad. The sealed sub-pad has a sealing mechanism that mitigates liquid penetration into the sub-pad thereby maintaining a substantially uniform compressibility of the sub-pad and the polishing pad and extending a useable life of the polishing pad.

4 Claims, 10 Drawing Sheets

EDGE-SEALED PAD FOR CMP PROCESS

This application is a divisional of application Ser. No. 10/434,246, filed May 8, 2003, now U.S. Pat. No. 6,783,437.

FIELD OF THE INVENTION

The present invention relates generally to semiconductor fabrication, and more particularly, to systems and methods that mitigate altering of a chemical mechanical planarization pad compressibility and spatial uniformity and facilitate chemical mechanical planarization process stability.

BACKGROUND OF THE INVENTION

Semiconductor device fabrication involves performing a variety of processes, procedures and operations in order to achieve a fabricated device. These operations include, but are not limited to, layering, doping, heat treatments, and patterning. Layering is the operation used to add layers of a selected thickness to a wafer surface. These layers can be insulators, semiconductors, conductors, and the like and can be grown or deposited by a number of suitable methods (e.g., chemical vapor deposition, sputtering, and the like).

Doping is the process that introduces specific amounts of dopants in the wafer surface through openings in surface layers. Two general techniques of doping are thermal diffusion and ion implantation. Doping is used, for example, to create active regions in transistors.

Heat treatments are operations in which a wafer is heated and cooled to achieve specific results. Generally, no additional material is added although contaminates and vapors may evaporate from the wafer surface. A common heat treatment is called an anneal which is employed to repair damage to crystal structures introduced by ion implantation.

Patterning is the operation that employs a series of steps that results in the removal of selected portions of added surface layers. After removal, a pattern of the layer is left on the wafer surface. The material removed can be in the form of a hole in the layer or a remaining island of the material. The patterning operation is also known by the names of photomasking, masking, photolithography, and microlithography.

Another important operation is chemical mechanical planarization (CMP), which can be employed in patterning operations. Generally, planarization is a process by which a wafer topography is made substantially flat or planar. CMP is a type of planarization process in which chemical and mechanical components are employed to planarize a wafer surface. Typically, a slurry comprised of a chemical component and mechanical components (e.g., abrasive particles) is flowed onto a wafer surface and a rotating pad is pressed against the wafer surface. The components chemically and mechanically remove portions of the wafer surface. The combined actions of the slurry and the rotating pad result in a polishing operation that can planarize the wafer surface.

In order to achieve a planar surface, it is important that the polishing pad be substantially spatially uniform with regard to compressibility. Non-uniformities can result in defects and/or a non-planar surface. Accordingly, it is desirable that a polishing pad be able to maintain its uniformity with regard to compressibility even after repeated use.

SUMMARY OF THE INVENTION

The following presents a simplified summary in order to provide a basic understanding of one or more aspects of the invention. This summary is not an extensive overview of the invention, and is neither intended to identify key or critical elements of the invention, nor to delineate the scope thereof. Rather, the primary purpose of the summary is to present some concepts of the invention in a simplified form as a prelude to the more detailed description that is presented later.

The present invention includes a polishing pad that can facilitate process stability, extend length of use, and mitigate process non-uniformity and process induced defects for chemical mechanical planarization processes. The polishing pad of the present invention is a composite of a top pad and a sealed sub-pad. The sealed sub-pad has a sealing mechanism that mitigates liquid penetration into the sub-pad thereby maintaining a substantially spatially uniform compressibility of the sub-pad and the polishing pad and extending a useable life of the polishing pad.

To the accomplishment of the foregoing and related ends, the invention comprises the features hereinafter fully described and particularly pointed out in the claims. The following description and the annexed drawings set forth in detail certain illustrative aspects and implementations of the invention. These are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION OF THE INVENTION

The present invention will now be described with respect to the accompanying drawings in which like numbered elements represent like parts. The figures provided herewith and the accompanying description of the figures are merely provided for illustrative purposes. One of ordinary skills in the art should realize, based on the instant description, other implementations and methods for fabricating the devices and structures illustrated in the figures and in the following description.

An important characteristic to achieve substantially planar and uniform surfaces by planarization procedures is to employ a polishing pad that, among other characteristics, has a substantially spatially uniform compressibility throughout the pad. The present invention discloses a polishing pad that facilitates process stability, extends length of use, and mitigates process non-uniformity and process induced defects for chemical mechanical planarization (CMP) processes. The polishing pad of the present invention comprises a top pad adhered to a sealed sub-pad. The sealed sub-pad has a sealing mechanism that mitigates liquid penetration into the sub-pad, thereby maintaining a substantially spatially uniform compressibility of the sub-pad and the polishing pad and extending a useable life of the polishing pad.

Figure 1:
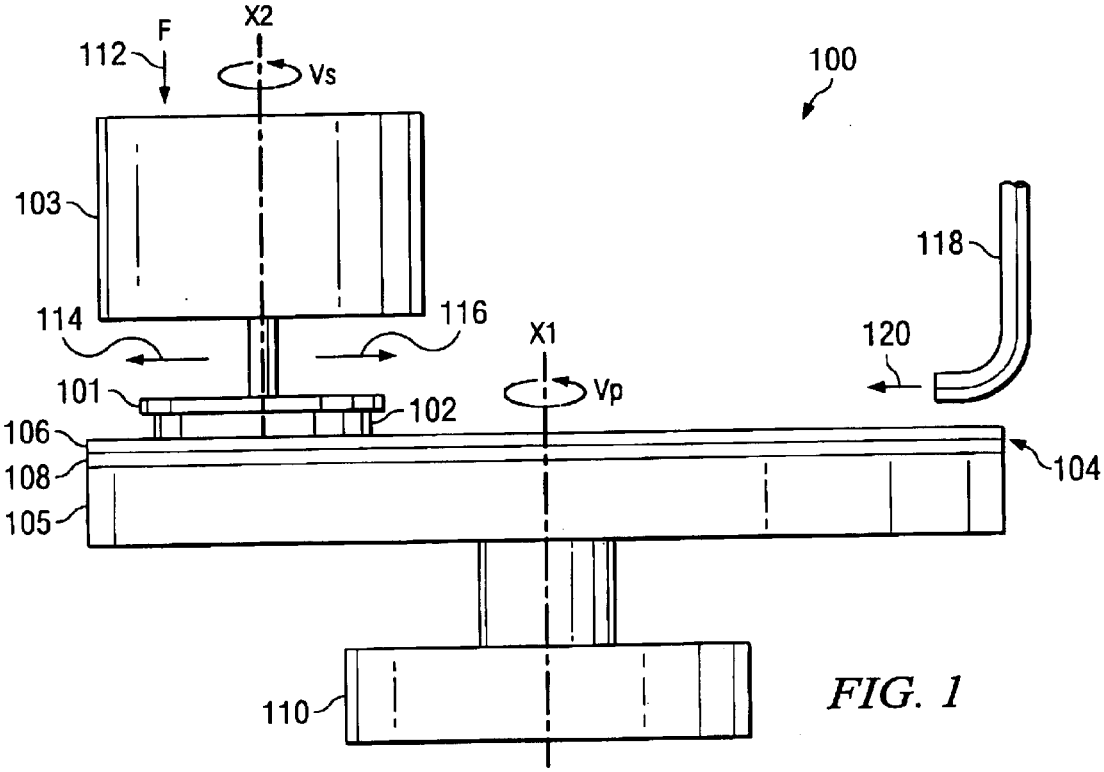
FIG. 1 is a schematic view of a system for performing chemical mechanical planarization in accordance with an aspect of the present invention.
Figure 2:
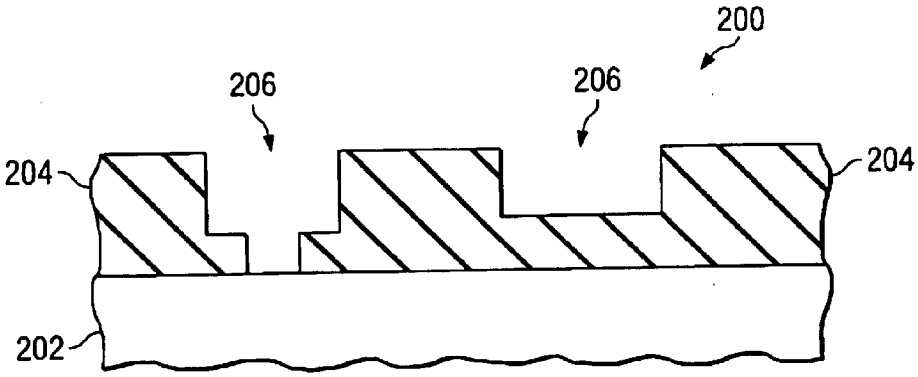
FIG. 2 (PRIOR ART)
FIG. 2 is a schematic diagram of an exemplary semiconductor device in accordance with an aspect of the present invention.

FIG. 1 is a schematic view of a polishing system 100 for performing chemical mechanical planarization in accordance with an aspect of the present invention. The system operates on a wafer or substrate 102 and includes a polishing head 101, a polishing head displacement mechanism 103, a pad 104, a platen 105, and a motor driver or drive mechanism 110.

The pad 104 is a composite of a top pad 106 and a sealed sub-pad 108, also referred to as a bottom pad. The top pad 106 is comprised of a suitable material such as plastic, polyurethane, cast polyurethane, foam, cast polyurethane foam with fillers, polyurethane impregnated felts, and the like. The top pad 106 has selected properties for porosity, compressibility, and hardness. The sub-pad is comprised of a suitable material such as plastic, polyurethane, foam, polyester cast with a polyurethane resin, cast polyurethane foam with fillers, polyurethane impregnated felts, and the like. The sub-pad 108 also has selected properties for porosity, compressibility, and hardness. Generally, the top pad 106 is more rigid or hard than the sub-pad 108 so as to provide a sufficiently rigid polishing surface. Typically, stiffness provides better within-die uniformity. The sub-pad 108 is generally less rigid than the top pad 106, is relatively compressible, and has greater compressibility than the top pad 106.

An important characteristic of the pad 104 is that overall compressibility of the pad 104 be substantially uniform spatially or radially. The compressibility is largely a function of the sub-pad 108, which remains substantially uniform, even after repeated use. The sub-pad 108 has edges sealed with a liquid resistant material so that liquids and/or chemicals employed during planarization process do not substantially enter the sub-pad 108 thereby avoiding loss of uniformity of compressibility.

The pad 104 is attachable to the platen 105, typically by a suitable adhesive. The platen 105 is coupled to the drive mechanism 110 to impart rotational movement to the platen 105 and thereby the pad 104. During operation, the platen 105 is rotated at a velocity Vp about a center axis X1 in both a clockwise and a counter-clockwise direction.

The polishing head 101 is mounted above the platen 105 and the pad 104 and generally includes a pocket or other mechanism (not shown) that holds the wafer 102 in place (e.g., typically via a vacuum). During operation, the polishing head 101 applies a controlled pressure behind the wafer 102 indicated by the arrow 112 urging the wafer 102 against the pad 104 to facilitate polishing of the wafer surface. The polishing head displacement mechanism 103 is coupled to the polishing head 101 and rotates the polishing head 101 at a velocity Vs in a clockwise or counter-clockwise direction about an axis X2. The polishing head displacement mechanism 103 also can move the polishing head 101 radially across the platen 105 as indicated by arrows 114 and 116.

Additionally, the system 100 includes a chemical supply system 118 for introducing a chemical slurry of a desired composition to the pad 104. During operation, the chemical supply system 118 introduces the slurry as indicated by arrow 120 on the pad 104 at a selected rate.

FIGS. 2–5 illustrate exemplary semiconductor device fabrication and serve to illustrate issues and problems encountered by lack of uniformity of a pad employed in a chemical mechanical planarization process. Beginning with FIG. 2, a schematic diagram of an exemplary semiconductor device 200 at an initial stage of fabrication is depicted. The device includes a substrate 202 (e.g., wafer) comprised of one or more semiconductor layers and an interdielectric layer 204 formed on the substrate 202. One or more regions 206 have been patterned in the dielectric 204.

Figure 3:
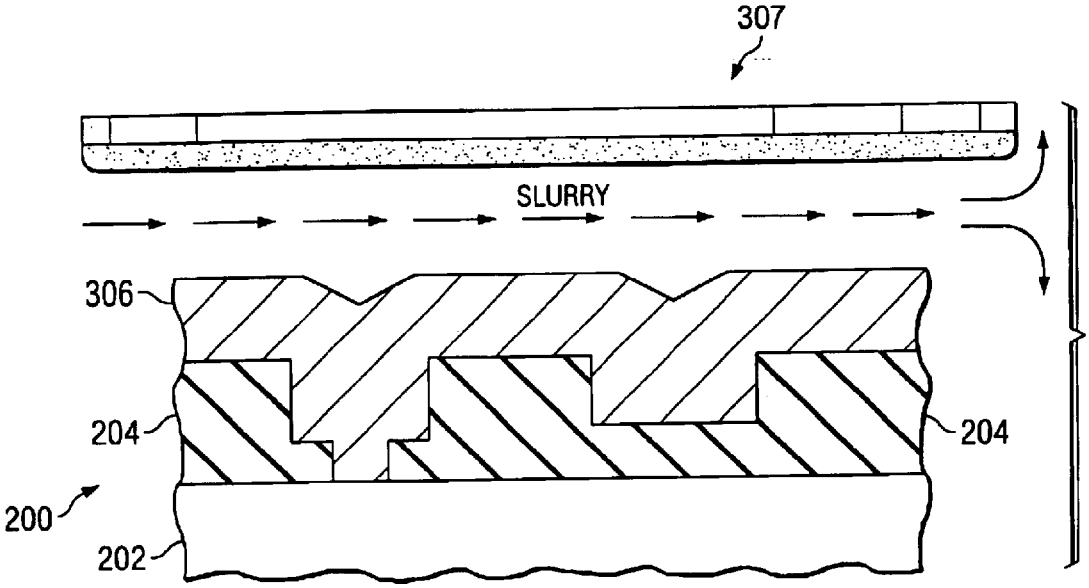
FIG. 3 (PRIOR ART)
FIG. 3 is a schematic diagram of an exemplary semiconductor device in accordance with an aspect of the present invention.

FIG. 3 is a schematic diagram of the exemplary semiconductor device 200. At this stage of fabrication, a conductive material 306 has been deposited (e.g., overfilled) on the dielectric layer 204 and filling the regions 206. A chemical mechanical planarization process is performed on the device 200 in which a rotating pad 307 is pressured against a surface of the device 200 to selectively remove excess conductive material. Additionally, a slurry containing small abrasive particles is flowed onto the surface of the device 200. The particles remove small pieces of the surface material (e.g., conductive material), which are then carried away by movement of the slurry across the surface.

Figure 4:
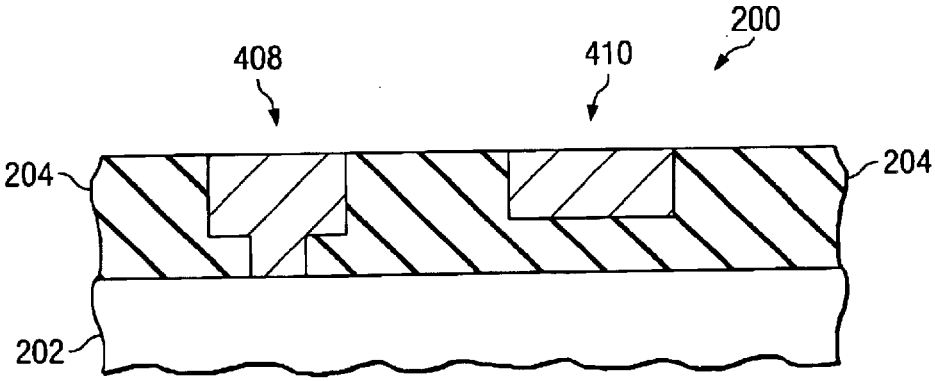
FIG. 4 (PRIOR ART)
FIG. 4 is a schematic diagram of an exemplary semiconductor device after processing with a substantially spatially uniform pad in accordance with an aspect of the present invention.

As is discussed supra, uniformity of the pad 307 employed in the chemical mechanical planarization process is an important characteristic of the process. FIG. 4 is a diagram of the exemplary semiconductor device after processing with a substantially uniform pad. The chemical mechanical planarization process has selectively removed portions of the conductive material 306 so as to leave a conductive line and plug 408 and a conductive line 410.

Figure 5:
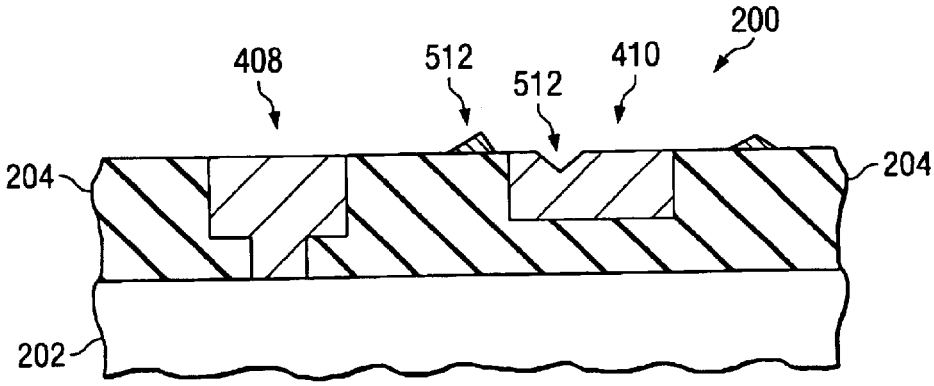
FIG. 5 (PRIOR ART)
FIG. 5 is a schematic diagram of an exemplary semiconductor device after processing with a substantially non-uniform pad in accordance with an aspect of the present invention.

FIG. 5 is a diagram of the exemplary semiconductor device after processing with a substantially non-uniform pad. The chemical mechanical planarization process has selectively removed portions of the conductive material 306 so as to leave a line 410 and a contact 408, but has also left a number of defects 512 due to non-uniformities of the pad 307. Note that the non-uniformities illustrated in FIG. 5 may not be fully drawn to scale, and are provided for purposes of simplicity and illustration.

Figure 6:
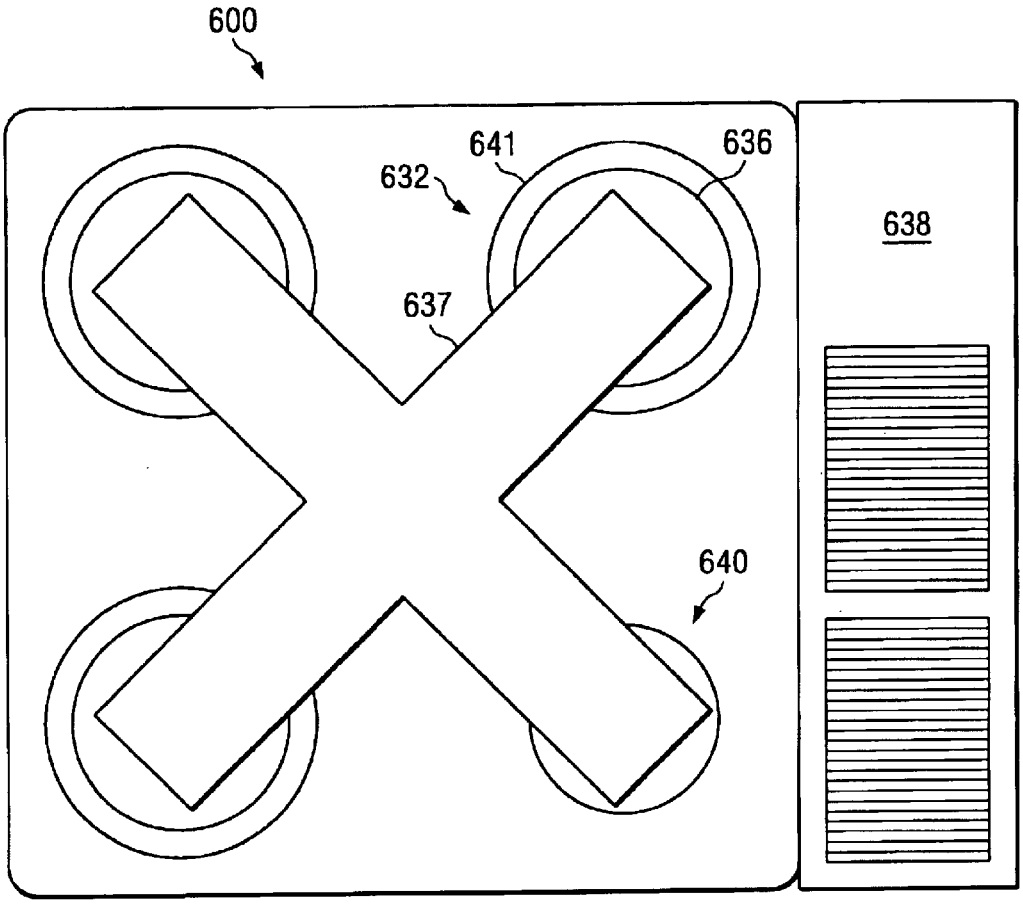
FIG. 6 is a schematic top view of a chemical mechanical planarization system in accordance with an aspect of the present invention.

FIG. 6 is a schematic top view of a chemical mechanical planarization system 600, such as a Mirra® chemical mechanical planarization system available from Applied Materials, Inc., located in Santa Clara, Calif., in accordance with an aspect of the present invention. The system 600 includes three polishing stations 632 and a loading station 640. Four polishing heads 636 are rotatably mounted to a polishing head displacement mechanism 637 disposed above the polishing stations 632. A front-end substrate transfer region 638 is disposed adjacent to the system 600 and may be considered as part of the system.

Generally, a wafer or substrate is loaded on a polishing head 636 at the loading station 640 and is then rotated through the three polishing stations 632. The polishing stations each comprise a rotating platen 641 having polishing pads comprised of a top pad and an edge sealed sub-pad mounted thereon. One exemplary process sequence includes a polishing pad at the first two stations and a cleaning pad at the third station to facilitate wafer cleaning at the end of the polishing/planarizaiton procedure.

Figure 7:
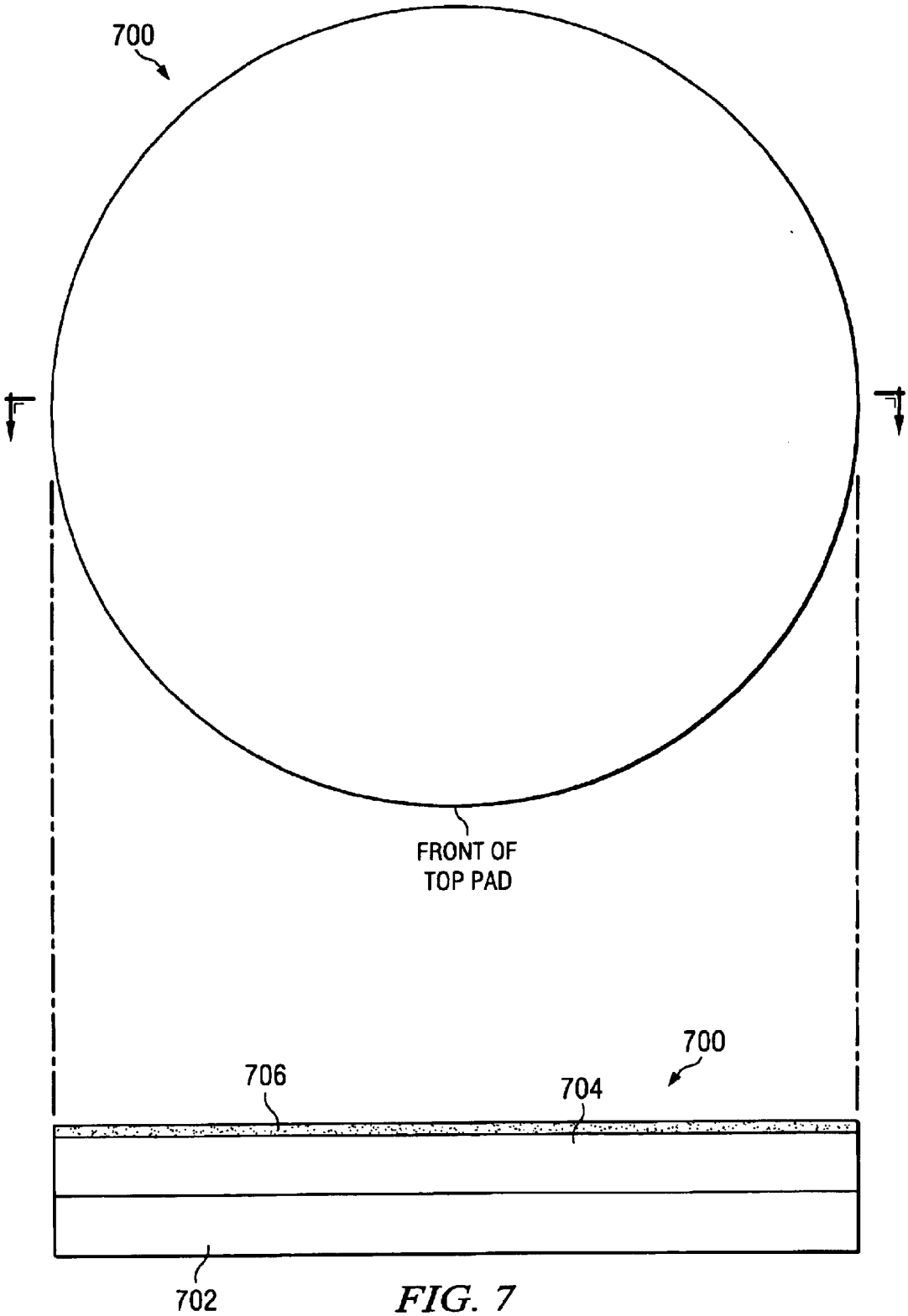
FIG. 7 (PRIOR ART)
FIG. 7 is a schematic diagram of a conventional polishing pad prior to substantial use.

Turning now to FIG. 7, a schematic diagram of a conventional polishing pad 700 is depicted. The pad 700 includes a top pad 702, a sub-pad 704, and an adhesive layer 706 and is depicted prior to substantial use. Uniform spatial compressibility is an important characteristic for the pad 700. In order to properly perform chemical mechanical planarization processes and obtain good process results, the pad 700 should maintain this characteristic. However, the sub-pad 704 is susceptible to damage from liquid (e.g., $H_2O$) and/or other products employed during planarization procedures.

Figure 8:
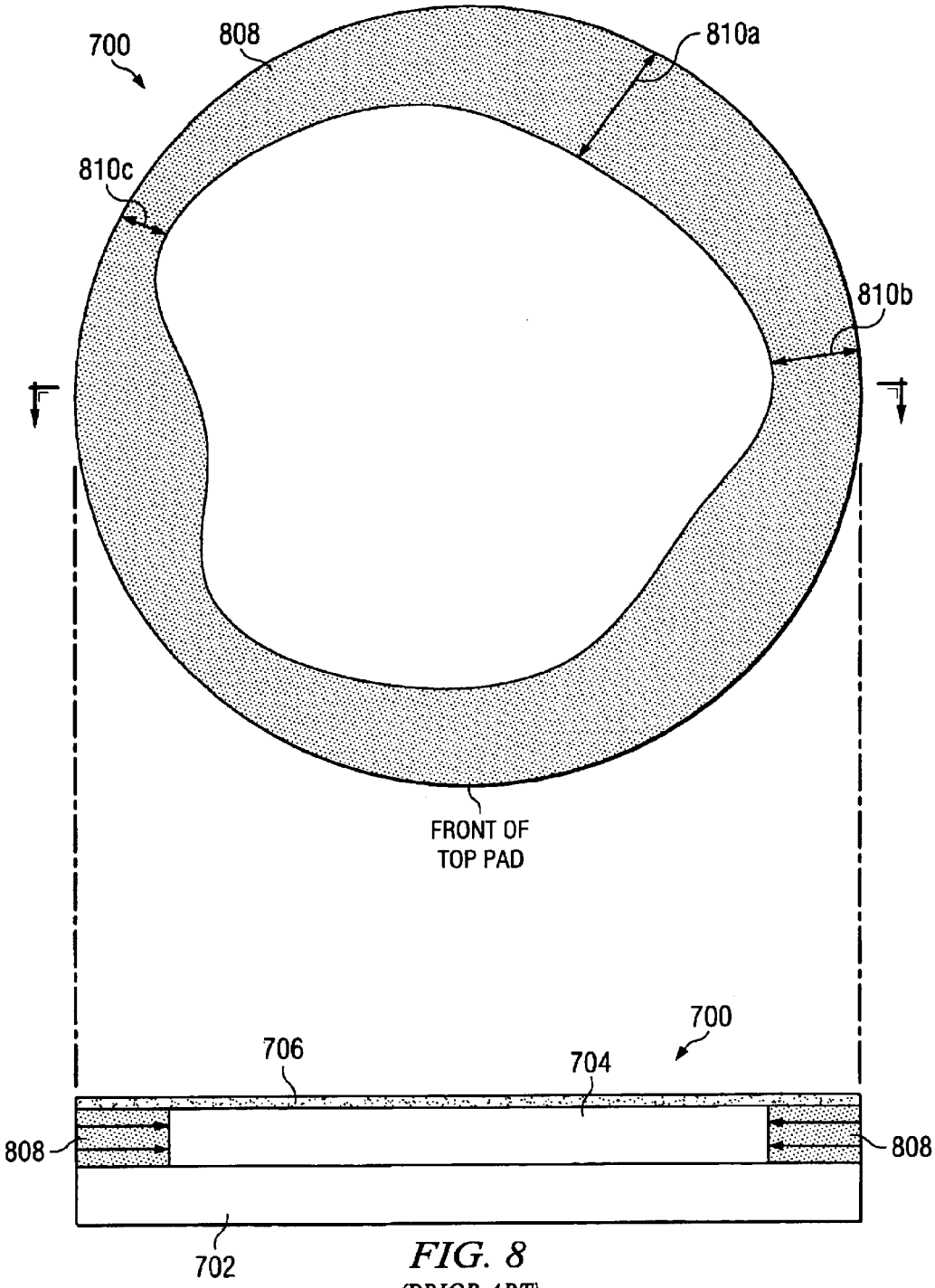
FIG. 8 (PRIOR ART)
FIG. 8 is a schematic diagram of a damaged, conventional polishing pad after substantial use.

FIG. 8 is a schematic diagram of the conventional polishing pad 700 after substantial use as appreciated by the inventor of the present invention. During normal, repeated use, the sub-pad 704 is susceptible to liquid penetration (e.g., slurry, surfactants, water, and the like). Once penetrated, the liquid can non-uniformly modify compressibility of the sub-pad. Here, liquid penetration 808 from a circumferential edge into the sub-pad 704 has modified spatial compressibility of the sub-pad as well as the overall compressibility of the pad 700. The liquid penetrated into the sub-pad 704 can, for example, corrode, leave deposits in, and react with the sub-pad 704 thereby altering compressibility. Chemical mechanical planarization processes performed with this damaged pad 700 can result in undesirable wafer edge profiles and the like. As illustrated in FIG. 8, not only is the spatial compressibility of the sub-pad 704 altered about its periphery, the variation in compressibility is non-uniform about the periphery, as highlighted at reference numerals 810*a,* 810*b,* and 810*c.*

Figure 9C:
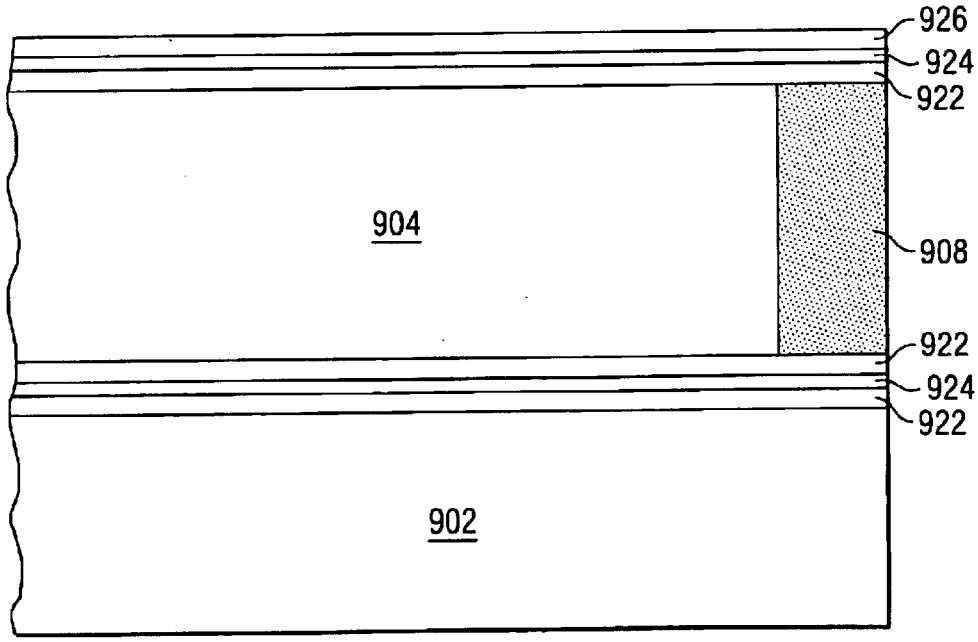
FIG. 9C is a detail view of a schematic diagram illustrating a polishing pad in accordance with an aspect of the present invention.
Figure 9A:
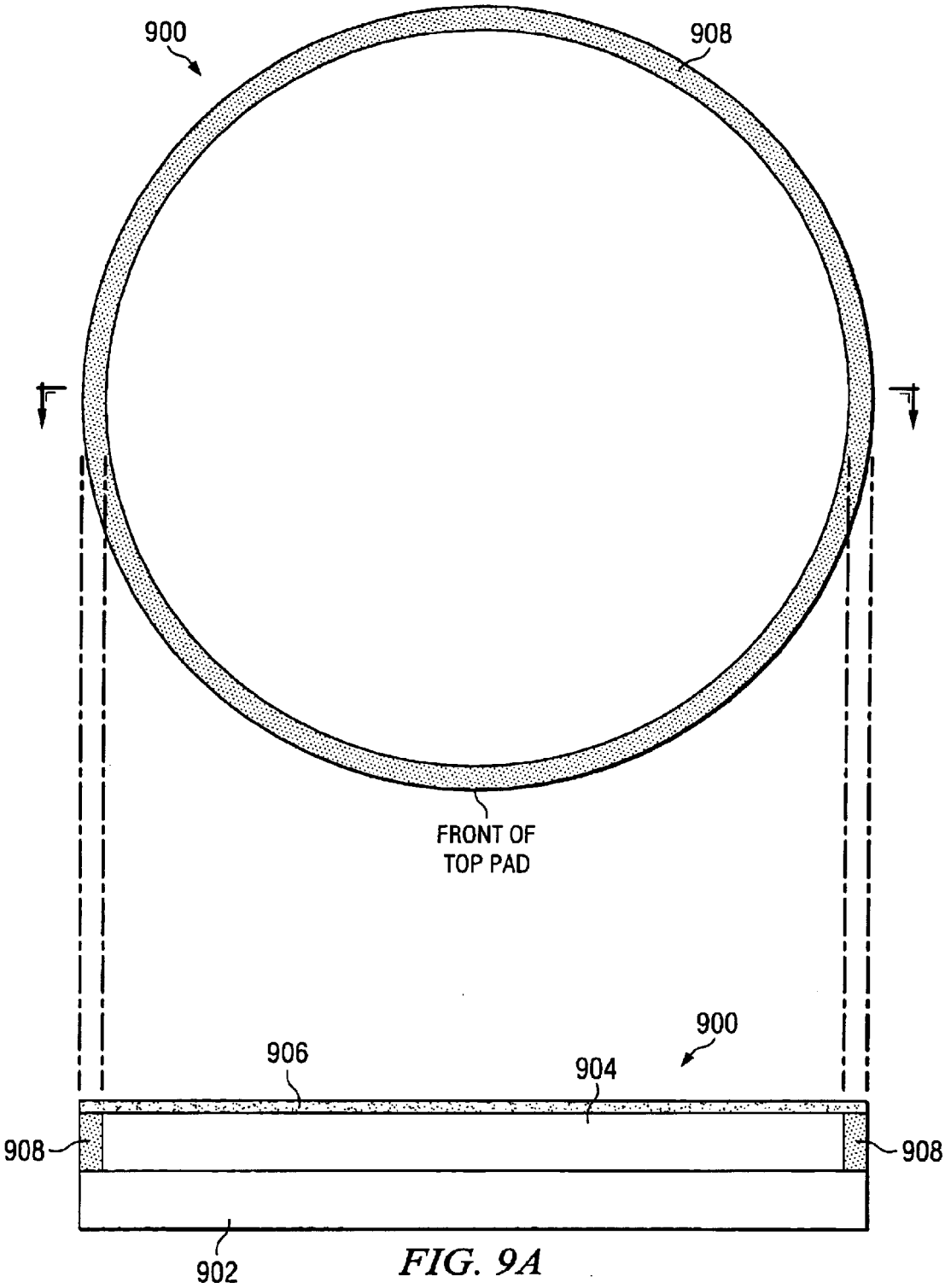
FIG. 9A is a schematic diagram illustrating a polishing pad in accordance with an aspect of the present invention.

FIG. 9A is a schematic diagram illustrating a polishing pad 900 in accordance with an aspect of the present invention. The polishing pad 900 is a composite of a top pad 902 and a sub-pad 904 secured to each other via an adhesive (not shown). The top pad 902 is comprised of a suitable material such as plastic, polyurethane, cast polyurethane, foam, and the like and the sub-pad is comprised of a suitable material such as plastic, polyurethane, foam, polyester cast with a polyurethane resin, and the like. Generally, the top pad 902 is more rigid than the sub-pad 904 so as to provide a sufficiently rigid polishing surface. The sub-pad 904 is generally less rigid and has greater compressibility than the top pad 902.

An important characteristic of the pad 900 is that overall compressibility of the pad 900 be substantially spatially uniform. The compressibility is largely a function of the sub-pad 904, which remains substantially uniform, even after repeated use. The sub-pad 904 has edges 908 sealed with a liquid resistant material so that liquids and/or chemicals employed during planarization process do not substantially enter the sub-pad 904 along the pad edge, thereby avoiding loss of uniformity of spatial or radial compressibility. An adhesive layer 906 is formed on the sub-pad 904 to facilitate adhering the pad 900 to a platen (not shown) for use in a chemical mechanical planarization system (e.g., see FIG. 5). The liquid resistant material can be an adhesive, such as the adhesive employed to attach the sub-pad 904 and the top pad 902 together or an adhesive employed in the adhesive layer 906.

It is appreciated that employing the sealed edge 908 can reduce usable area of the overall pad 900. Accordingly, the sealed edge 908 has a selected thickness that is thick enough to mitigate diffusion of liquids into the sub-pad 904 and yet that is thin enough to not substantially interfere with planarization processes performed with the pad. Generally, a certain portion, threshold, or ring around an outer edge of a pad is not employed during processing. As a result, a selected thickness for the sealed edge 908 that lies within the portion or ring not employed during processing is well suited. The selected thickness can be a function of polishing/planarization procedures to be performed, the size of the pad, and the liquids or slurry chemicals employed in the procedures. For example, a selected thickness of 0.4" is suitable for some CMP processes and is thick enough to mitigate liquid diffusion.

Figure 9B:
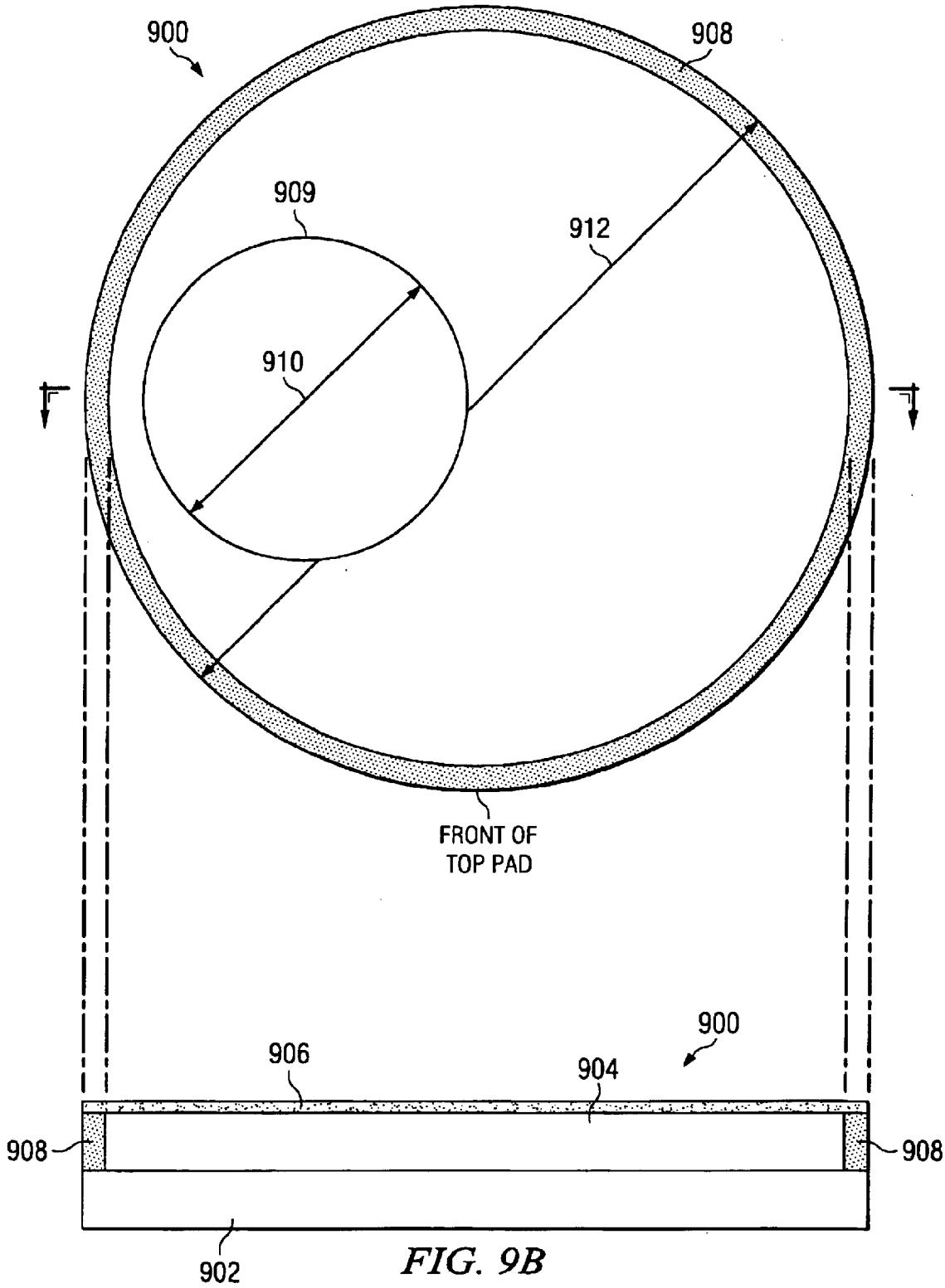
FIG. 9B is a schematic diagram illustrating a polishing pad in accordance with an aspect of the present invention.

FIG. 9B is a schematic diagram further illustrating the polishing pad 900 in accordance with an aspect of the present invention. Here, an exemplary target wafer 909 is depicted on or near the pad 900. The target wafer 909 has a diameter 910 less than a diameter 912 of the polishing pad 900. An exemplary value for the target wafer diameter 910 is about 8 inches and an exemplary value for the polishing pad diameter 912 is about 20 inches. However, other suitable values can be employed and still be in accordance with the present invention.

FIG. 9C is a detailed view schematic diagram further illustrating the polishing pad 900 (i.e., the edge portion of the pad) in accordance with an aspect of the present invention. Adhesive layers of a first type 922, mylar interposer layers 924, and an adhesive layer of a second type 926 are depicted to illustrate a typical, exemplary construction of the pad 900.

One of the mylar interposer layers 924 is sandwiched between two adhesive layers of the first type 922 and employed to attach the top pad 902 to the sub-pad 904. The other myler interposer layer 924 is sandwiched between an adhesive layer of the first type 922 and the adhesive layer of the second type 926, which can be used to attach the pad 900 to a platen. The first and/or second type of adhesive can be employed for the edge sealing mechanism 908.

Figure 10A:
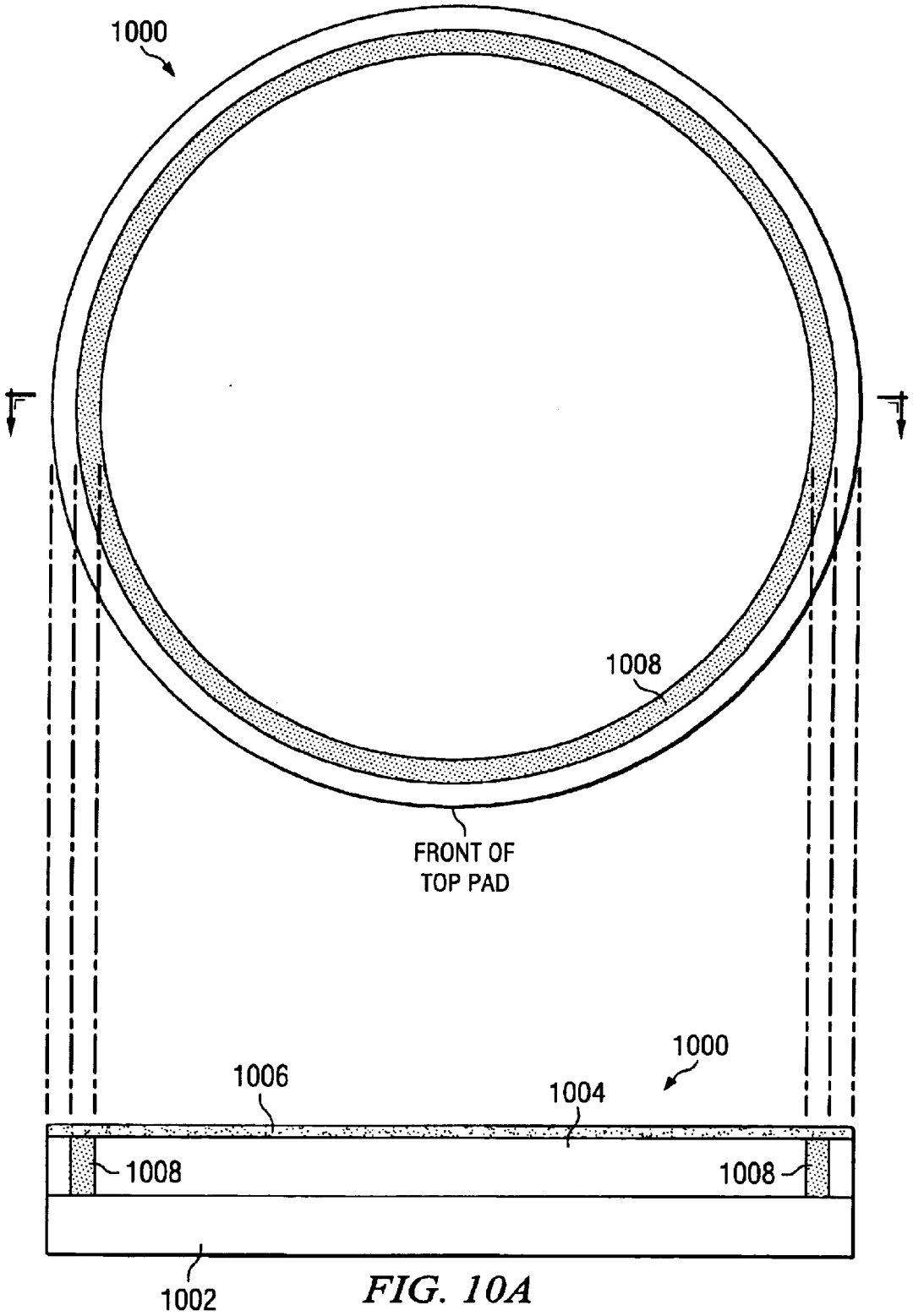
FIG. 10A is a schematic diagram illustrating a polishing pad in accordance with an aspect of the present invention.

FIG. 10A is a schematic diagram illustrating a polishing pad 1000 in accordance with an aspect of the present invention. The polishing pad 1000 is a composite of a top pad 1002 and a sub-pad 1004 secured to each other via an adhesive (not shown) and in this configuration is referred to as an edge groove pad. The top pad 1002 is comprised of a suitable material such as plastic, polyurethane, cast polyurethane, foam, and the like and the sub-pad is comprised of a suitable material such as plastic, polyurethane, foam, polyester cast with a polyurethane resin, and the like. Generally, the top pad 1002 is more rigid than the sub-pad 1004 so as to provide a sufficiently rigid polishing surface.

Typically, stiffness provides better within-die uniformity. Accordingly, the sub-pad 1004 is generally less rigid and has greater compressibility than the top pad 1002.

To facilitate planarization and/or polishing, it is desirable that the overall compressibility of the pad 1000 be substantially spatially uniform. The compressibility is largely a function of the sub-pad 1004, which remains substantially uniform, even after repeated use because the sub-pad 1004 has edges or grooves 1008 sealed or filled with a liquid resistant material so that liquids and/or slurry chemicals employed during planarization process do not substantially enter the sub-pad 1004 thereby avoiding loss of uniformity of compressibility. As one of many possible ways, the groove 1008 is cut into the sub-pad 1004 after the sub-pad 1004 is adhered to the top pad 1002. Then, the groove 1008 is filled with the liquid resistant material so as to prevent or mitigate liquid from entering the inner portion of the sub-pad 1004. An adhesive layer 1006 is formed on the sub-pad 1004 to facilitate adhering the pad 1000 to a platen (not shown) for use in a chemical mechanical planarization system (e.g., see FIG. 5). The liquid resistant material can be an adhesive, such as the adhesive employed to attach the sub-pad 1004 and the top pad 1002 together or an adhesive employed in the adhesive layer 1006.

The filled groove 1008 has a selected thickness that is thick enough to mitigate diffusion of liquids into the sub-pad 1004 and yet that is thin enough to not substantially interfere with planarization processes performed with the pad. Generally, a certain portion, threshold, or ring around an outer edge of a pad is not employed during processing. As a result, a selected thickness for the filled groove 1008 that lies within the portion or ring not employed during processing is well suited. The selected thickness can be a function of polishing/planarization procedures to be performed, the size of the pad, and the liquids or slurry chemicals employed in the procedures. For some CMP processes, the closest wafer edge to pad edge distance is about 0.4 inches. Thus, an exemplary groove thickness can range from about 0.1 inches to about 0.2 inches.

Figure 10B:
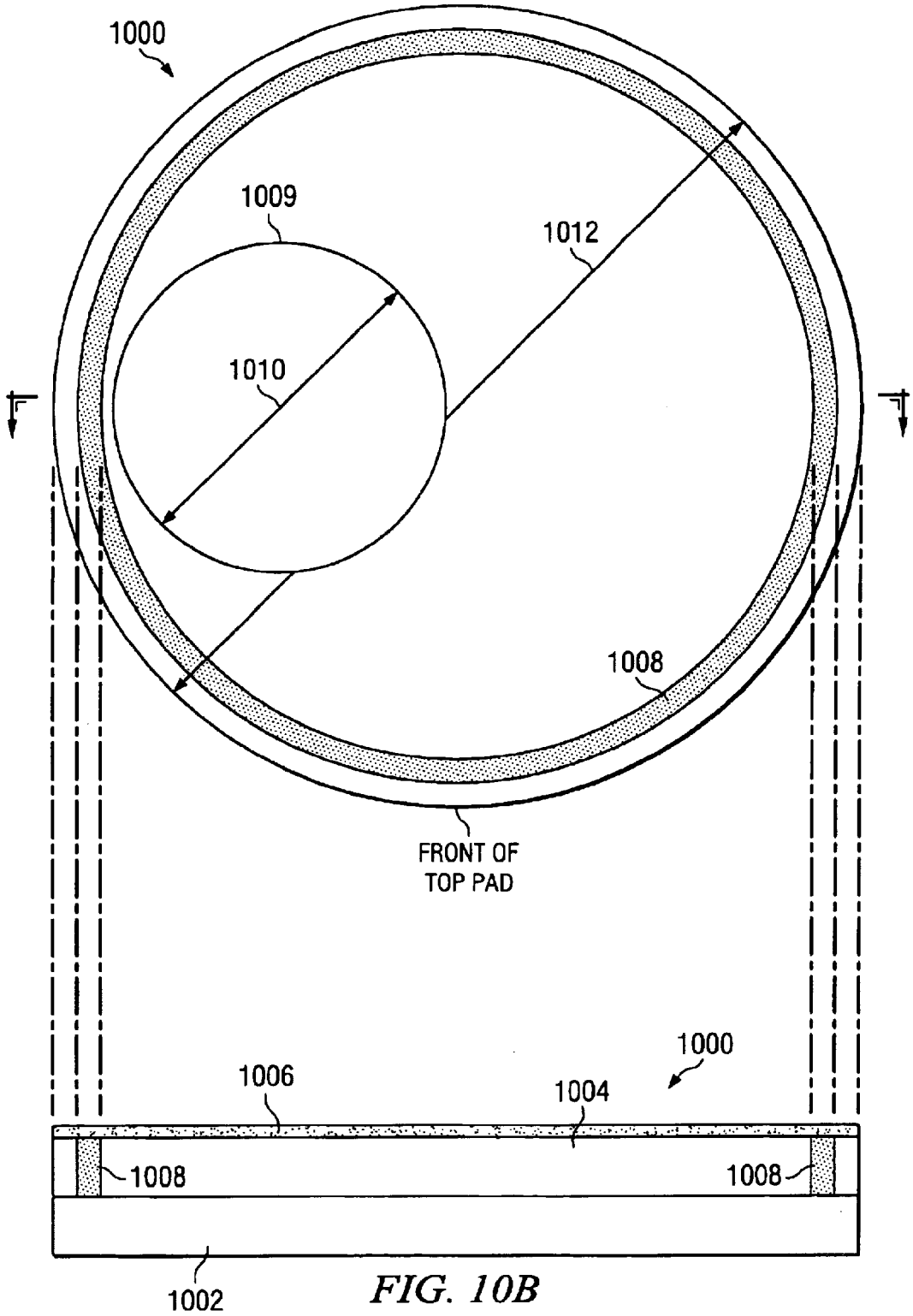
FIG. 10B is a schematic diagram illustrating a polishing pad in accordance with an aspect of the present invention.

FIG. 10B is a schematic diagram further illustrating the polishing pad 1000 in accordance with an aspect of the present invention. Here, an exemplary target wafer 1009 is depicted on or near the pad 1000. The target wafer 1009 has a diameter 1010 less than a diameter 1012 of the polishing pad 1000. An exemplary value for the target wafer diameter 1010 is about 8 inches and an exemplary value for the polishing pad diameter 1012 is about 20 inches. However, other suitable values can be employed and still be in accordance with the present invention.

Figure 10C:
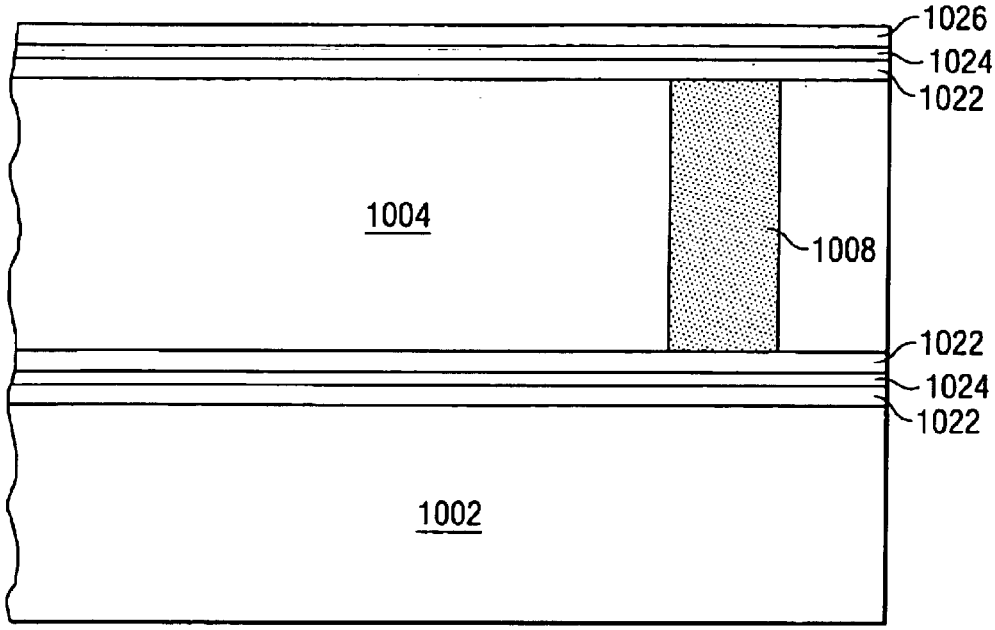
FIG. 10C is a detail view of a schematic diagram illustrating a polishing pad in accordance with an aspect of the present invention.

FIG. 10C is a detailed view schematic diagram further illustrating the polishing pad 1000 (i.e., the edge portion of the pad) in accordance with an aspect of the present invention. Adhesive layers of a first type 1022, mylar interposer layers 1024, and an adhesive layer of a second type 1026 are depicted to illustrate a typical, exemplary construction of the pad 1000.

One of the mylar interposer layers 1024 is sandwiched between two adhesive layers of the first type 1022 and employed to attach the top pad 1002 to the sub-pad 1004. The other myler interposer layer 1024 is sandwiched between an adhesive layer of the first type 1022 and the adhesive layer of the second type 1026, which can be used to attach the pad 1000 to a platen. The first and/or second type of adhesive can be employed for the edge sealing mechanism 1008.

It is appreciated that other suitable mechanisms in addition to those described in FIGS. 9A, 9B, 9C, 10A, 10B, and 10C can be employed to mitigate liquid migration into a sub-pad in accordance with the present invention. Additionally, the liquid resistant material can be a suitable material other than an adhesive so long as the liquid resistant material mitigates liquid migration (e.g., water, slurry, and the like).

As discussed supra, the present invention contemplates variations of the aspects discussed with respect to FIGS. 9A and 10A. One such exemplary variation is a pad that has an edge sealing mechanism at the edge of the sub-pad as described in FIG. 9A and also includes one or more concentric rings of grooves filled with a liquid resistant material similar to the filled groove described in FIG. 10A.

Figure 11:
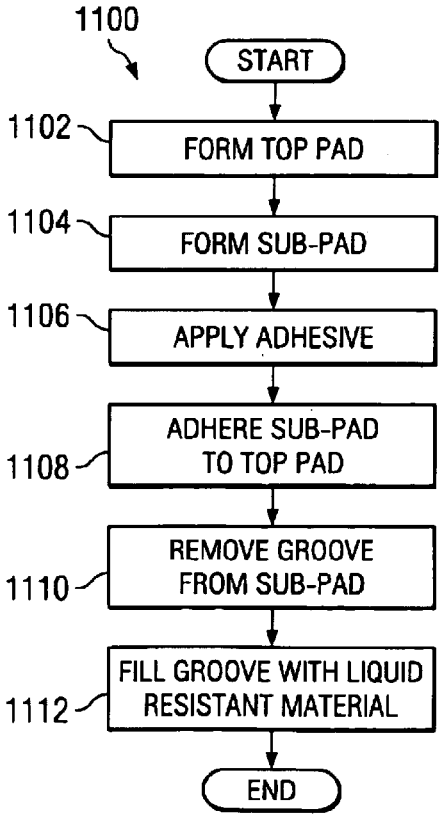
FIG. 11 is a flow diagram illustrating a method of fabricating a polishing pad in accordance with an aspect of the present invention.
Figure 12:
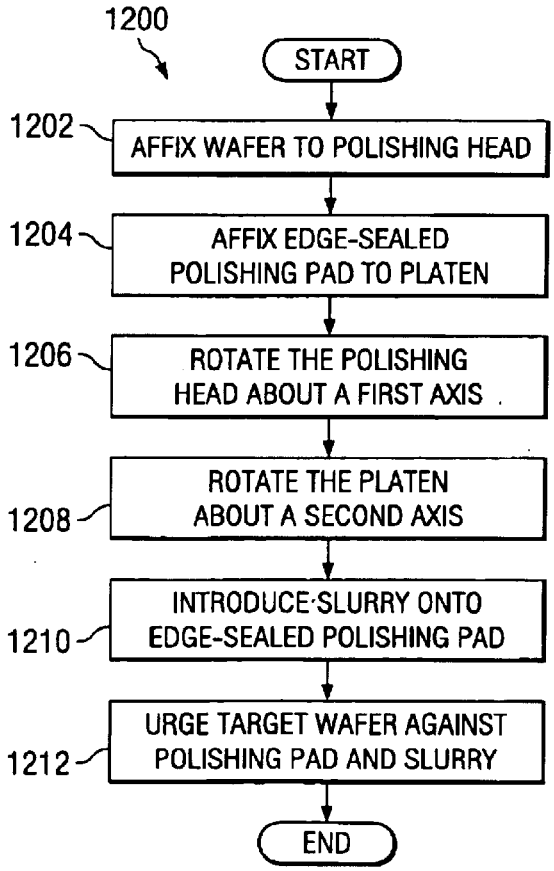
FIG. 12 is a flow diagram illustrating a method of performing a chemical mechanical planarization process in accordance with an aspect of the present invention.

In view of the foregoing structural and functional features described supra, methodologies in accordance with various aspects of the present invention will be better appreciated with reference to FIGS. 11–12. While, for purposes of simplicity of explanation, the methodologies of FIGS. 11–12 are depicted and described as executing serially, it is to be understood and appreciated that the present invention is not limited by the illustrated order, as some aspects could, in accordance with the present invention, occur in different orders and/or concurrently with other aspects from that depicted and described herein. Moreover, not all illustrated features may be required to implement a methodology in accordance with an aspect of the present invention.

Turning now to FIG. 11, a flow diagram illustrating a method 1100 of fabricating a polishing pad in accordance with an aspect of the present invention is presented. The method 1100 fabricates a polishing pad that includes a sealing mechanism that mitigates liquid penetration of a sub-pad.

Beginning at block 1102, a top pad having a substantially circular shape is formed. Additionally, the top pad is formed so as to have a selected porosity, a selected compressibility, and a selected hardness with a suitable material such as plastic, polyurethane, cast polyurethane, foam, cast polyurethane foam with fillers, polyurethane impregnated felts, and the like. A sub-pad also having a substantially circular shape is formed at block 1104. The sub-pad is comprised of a suitable material such as plastic, polyurethane, foam, polyester cast with a polyurethane resin, cast polyurethane foam with fillers, polyurethane impregnated felts, and the like. The sub-pad is formed so as to have a selected porosity, a selected, uniform compressibility, and a selected hardness. Generally, the top pad is formed to be more rigid or hard than the sub-pad so as to provide a sufficiently rigid polishing surface. Generally, stiffness provides better within-die uniformity. Accordingly, the sub-pad is generally less rigid than the top pad, is relatively compressible, and has greater compressibility than the top pad.

Continuing at block 1106, a layer of adhesive is applied to the top pad. The adhesive can be any suitable adhesive, but is generally liquid resistant. Subsequently, the sub-pad is adhered to the top pad by the layer of adhesive at block 1108. A groove of a fixed width is selectively removed from the sub-pad near an outer edge at block 1110. It is appreciated that the groove can be located at the outer edge. Then, the groove is filled with a liquid resistant material at block 1112, which can be the same material employed in the layer of adhesive.

The pad fabricated by this method 1100 can then be affixed to a platen and employed in a chemical mechanical planarization process. The groove filled with the liquid resistant material acts as a sealing mechanism and mitigates liquid penetration of the sub-pad and can maintain uniformity of compressibility of the sub-pad.

FIG. 12 is a flow diagram illustrating a method 1200 of performing a chemical mechanical planarization process in accordance with an aspect of the present invention.

A target wafer is affixed to a polishing head at block 1202. Typically, a vacuum is employed to initially secure the wafer. Then, a pocket (e.g., wafer retaining ring) or other structure in the polishing head holds the wafer on the polishing head. At block 1204, an edge-sealed polishing pad is affixed to a platen. The edge-sealed polishing pad comprises a top pad and a sealed sub-pad that includes a sealing mechanism. The edge-sealed polishing pad can be fabricated via method 1100 of FIG. 11 and/or variations thereof. Generally, the edge-sealed polishing pad is affixed to the platen by way of an adhesive.

The polishing head is rotated about a first axis in a first direction and at a first velocity at block 1206. The platen is rotated about a second axis in a second direction and at a second velocity at block 1208. The second axis is substantially parallel to the first axis. The first and second directions are clockwise or counter-clockwise. Additionally, both the first and the second directions can be the same or opposite.

A slurry composition is introduced onto the edge sealed polishing pad at block 1210. The slurry composition comprises a chemical component and abrasive particles that facilitate planarization. The target wafer, while rotating, is urged against the edge-sealed pad, also rotating, causing the slurry to polish/planarize a surface of the wafer at block 1212.

The method 1200 can be repeated with the same or varied slurry so as to achieve a desired planarization. Additionally, a cleaning process which employs water or another cleaning solution can be performed to remove any unwanted residual particles or materials from the wafer surface.

Although the invention has been shown and described with respect to a certain aspect or various aspects, it is obvious that equivalent alterations and modifications will occur to others skilled in the art upon the reading and understanding of this specification and the annexed drawings. In particular regard to the various functions performed by the above described components (assemblies, devices, circuits, etc.), the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several aspects of the invention, such feature may be combined with one or more other features of the other aspects as may be desired and advantageous for any given or particular application. Furthermore, to the extent that the term "includes" is used in either the detailed description or the claims, such term is intended to be inclusive in a manner similar to the term "comprising."

What is claimed is:

1. A method of fabricating a polishing pad comprising:

forming a top pad having a substantially circular shape and a sufficiently rigid polishing surface;

forming a sub-pad having a substantially circular shape and a sufficient compressibility;

applying a layer of adhesive to the top pad;

affixing the sub-pad to the top pad;

selectively removing a groove from the sub-pad near an outer edge; and filling the groove with a liquid resistant material.

2. The method of claim 1, wherein the groove is removed at the outer edge of the sub-pad.

3. The method of claim 1, wherein the liquid resistant material employed to fill the groove is a liquid resistant adhesive.

4. The method of claim 1, further comprising mitigating liquid penetration into the sub-pad by the liquid resistant material.

* * * * *